United States Patent [19]

Spiegel

[11] 4,138,083

[45] Feb. 6, 1979

[54] DEMONSTRATION MIRROR MOUNTING

[75] Inventor: Samuel Spiegel, Silver Spring, Md.

[73] Assignee: Hamilton & Spiegel, Inc., Tuxedo, Md.

[21] Appl. No.: 815,948

[22] Filed: Jul. 15, 1977

[51] Int. Cl.[2] ..... A47G 1/24

[52] U.S. Cl. ..... 248/474; 35/58

[58] Field of Search ..... 248/474, 469; 35/58, 35/62; 350/300, 301, 288; 362/140

[56] References Cited

U.S. PATENT DOCUMENTS

| | | | |
|---|---|---|---|
| 128,503 | 7/1872 | Patterson | 248/474 X |
| 1,584,105 | 5/1926 | Lenz | 350/288 X |
| 1,832,248 | 11/1931 | Schrader | 350/288 |
| 2,313,838 | 3/1943 | Nordquist | 362/140 |
| 3,148,461 | 9/1964 | Johnson | 35/62 |
| 3,276,731 | 10/1966 | Orchard | 350/299 X |

*Primary Examiner*—Francis K. Zugel
*Attorney, Agent, or Firm*—Samuel Lebowitz

[57] ABSTRACT

A readily portable mounting for an adjustable mirror adapted to be positioned over a demonstration area, and capable of convenient adjustment in both elevation and angularity to reflect the upper surface of a support below said mirror towards a viewing audience positioned remotely from said area. The frame for the mirror includes a channel surrounding the latter containing illuminating lamps for effectively casting light on the demonstration area and reflecting the view laterally therefrom. The effectiveness of the apparatus as a demonstration and teaching tool, is enhanced by providing a chalk-board on the mirror frame on the side opposite the mirror, which may be used as an adjunct to complement the visual and/or vocal demonstration or lecture.

4 Claims, 7 Drawing Figures

DEMONSTRATION MIRROR MOUNTING

This invention relates to a readily portable wheeled frame for supporting a large mirror which may be adjusted both in elevation and in angular position to extend the demonstration area encompassed within said frame by reflecting the operating field in a lateral direction towards a large group of viewers at a distance from said area.

It is the object of the present invention to provide an adjustable illuminated mirror on a skeletal portable frame adapted to be positioned in overlying relation to a surgical table, stretcher support, or analogous device, so that the operations performed thereon may be viewed by a large number of persons positioned remotely from the operating support, without in any way hindering the one or more operatives who are executing, demonstrating or elucidating the procedures.

It is another object of the invention to provide a rugged and economical wheeled vehicle for supporting an illuminated reflecting mirror in adjustable positions to overlie a surgical table or similar device such as morgue cart or autopsy table, so that the surgeon, technician or lecturer may operate on the subject under study while affording full view of his activities to a large number of persons, such as students, who may be seated in a gallery remote from the operating area.

It is a particular object of the invention to simplify the adjustable mirror suspensions which have been used in medical schools and hospitals for demonstration purposes, of the type disclosed in U.S. Pat. Nos. 2,953,969, Sept. 27, 1960, and 3,469,814, Sept. 30, 1969. These adjustable suspensions, mounted on and extending from the ceiling of a room, are of relatively complex construction, and because of their fixed locations in the ceiling of the room, are restricted in their utilization capabilities. In contradistinction thereto, the instant invention permits universal use of the portable frame supporting the adjustable mirror for effective cooperation with surgical operating supports, stretchers, morgue carts and the like, so that a single unit may be used in many different locales wherever the need therefor arises.

The universal application of the invention is enhanced by the fact that the portable unit includes an effective source of illumination so that the operating procedures may be undertaken wherever a lighting power outlet is available. The invention does not require costly lighting arrangements, the power consumption of the lamps is slight, and the illumination is capable of variation.

Other objects and purposes will appear from the detailed description of the invention following hereinafter, taken in conjunction with the accompanying drawints, wherein FIG. 1 is a front elevation of the adjustable demonstration reflecting mirror in accordance with the invention;

Figure 2:
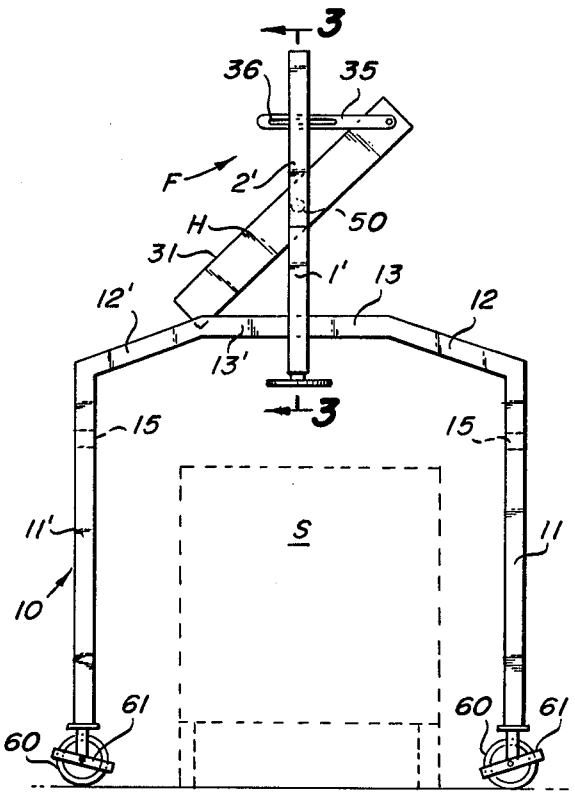
FIG. 2 is a left end view of FIG. 1, looking in the direction of line 2—2 of FIG. 1, with the mirror in tilted position to reflect the view of the top surface of the support underlying the mirror in a lateral direction towards the right.

The drawings illustrate a wheeled base comprised of longitudinally displaced end units 10 and 20 which support a frame member F between the upper portions thereof and in which is adjustably mounted a large plane reflecting mirror M. The housing H for the mirror is preferably of rectangular outline of a length many times its height and which includes channels between the edges of the housing and the outer edges of the mirror for mounting a plurality of fluorescent lamps which illuminate the area, as described in greater detail hereinafter.

The assembly may be fabricated from any suitable material, but stainless steel has been found preferable in view of its many desirable working properties and the ease of its maintenance in a clean condition. The overall dimensions of the base and frame member may be approximately eight and one-half feet in length, four feet in width and six and one-half feet in height.

The end unit 10 is formed of vertical legs 11 and 11', from the upper ends of which extend transversely the angular members 12 and 12', respectively, and which terminate in horizontal portions 13 and 13' at the top of the end unit which is at an elevation higher than the upper surface of the elevated support S. These component elements of the end unit are preferably formed of hollow stainless steel tubing of two inch by two inch external cross-section, and the inner ends of the horizontal portions 13,13' may be welded easily to the opposite faces of the lower portion 1' of the hollow vertical post of the frame member, which is likewise of stainless steel tubing of the same dimensions and section.

Figure 1:
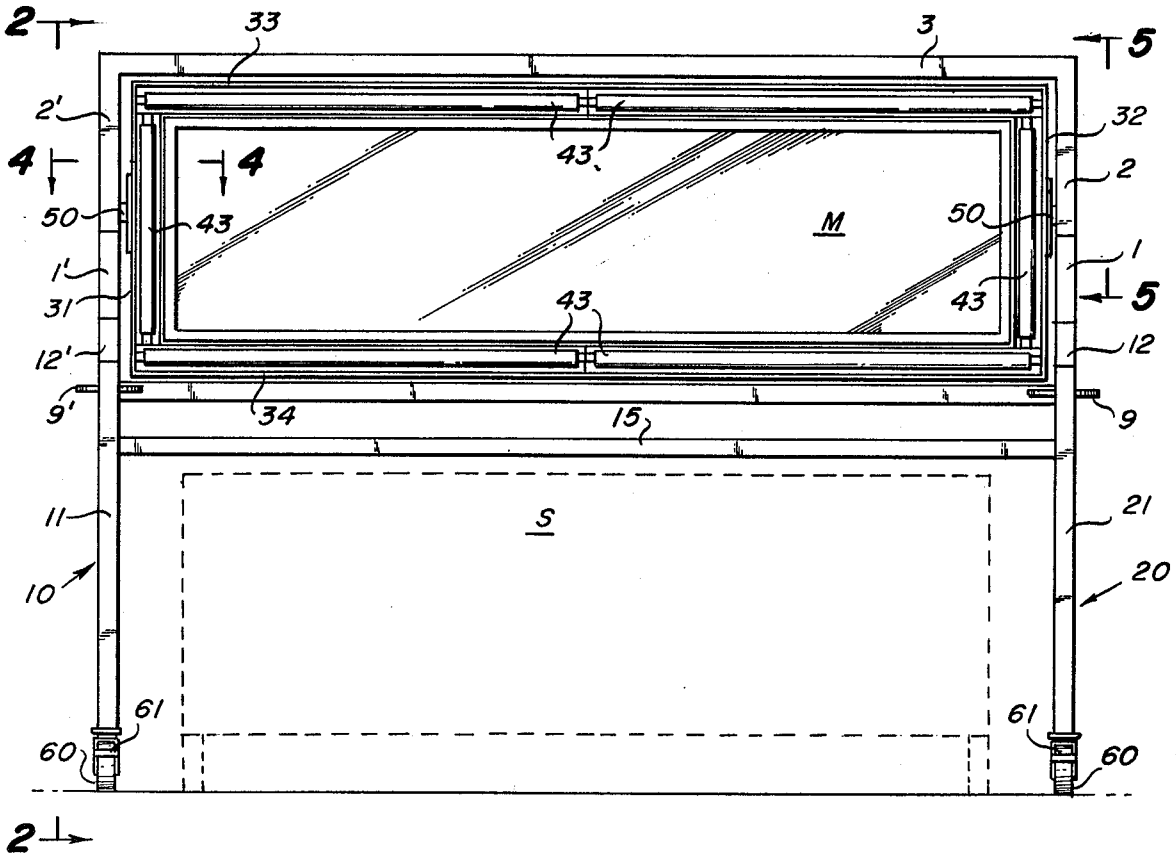

The end unit 20 at the right end of FIG. 1 is similarly formed of vertical legs 21,21' with transverse extensions at the upper ends, the free ends of which are welded to the lower portion of the vertical post 1 of the frame member, in the same manner as is shown for the frame member 1' in FIG. 2. The frame member F is completed by the horizontal beam 3 of hollow two inch by two inch stainless steel tubing extending between the tops of the vertical posts 2 and 2'.

Figure 5:
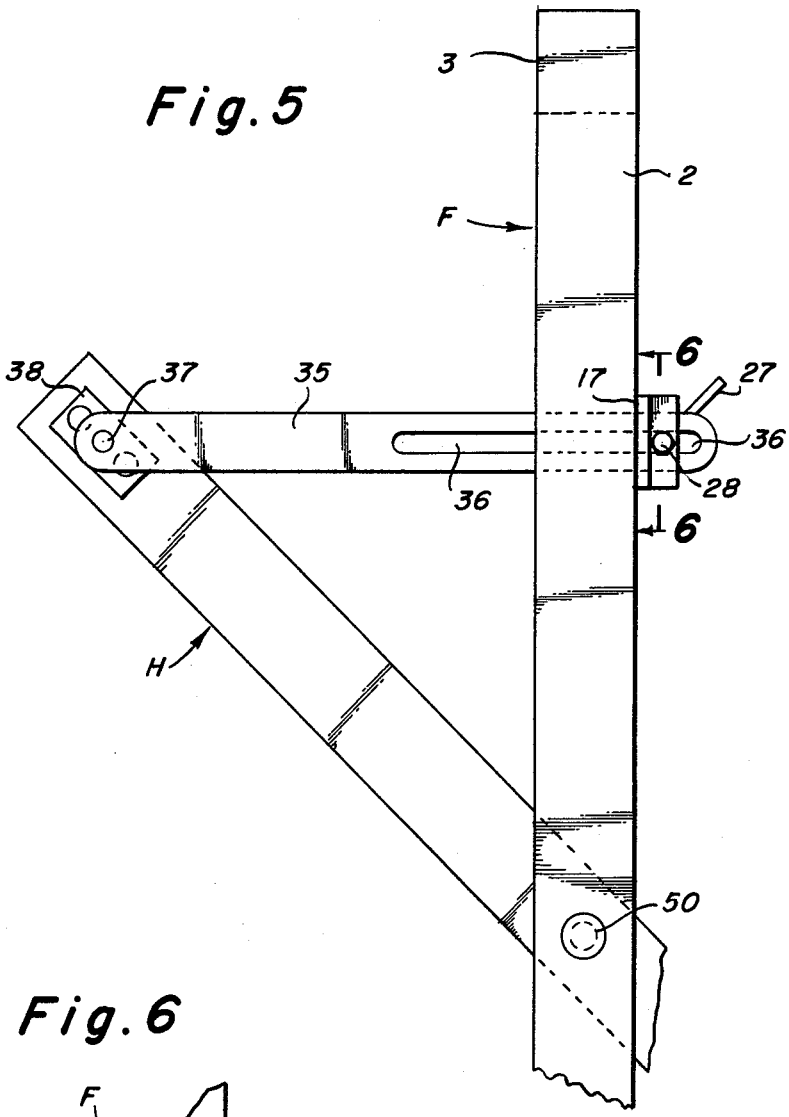
FIG. 5 is a vertial elevational view along line 5—5 of FIG. 1 when the mirror is in tilted position.
Figure 6:
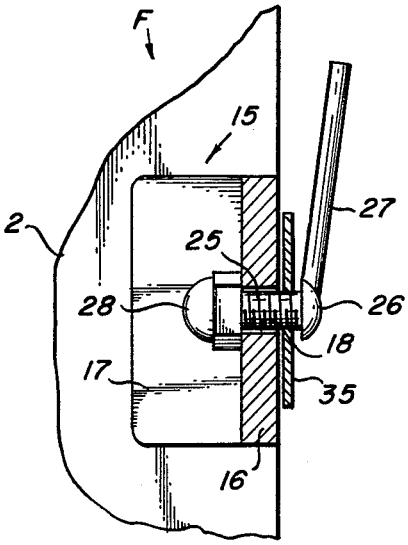
FIG. 6 is a vertical sectional view along line 6—6 of FIG. 5.
Figure 7:
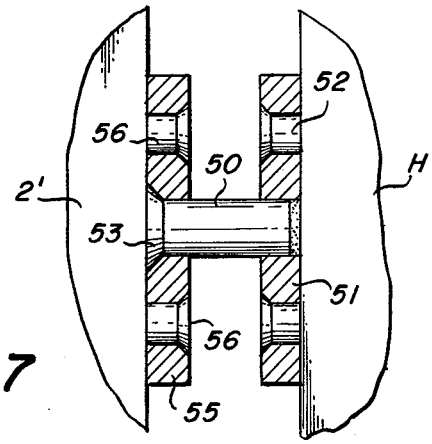
FIG. 7 is an enlarged elevation of the pivotal mounting at the left end of FIG. 1.

The mirror housing H is hingedly mounted on a horizontal axis between the vertical posts, as shown in greater detail in FIG. 7, and the hinge joint on each post is adjustable in elevation in order to raise the level of the pivotal axis of the mirror any desired distance above the top of the end units. Also, the mirror housing is capable of angular adjustment from the vertical plane shown in FIG. 1 to any desired acute angle to shift the angle of reflection of the area below the base in a lateral direction, details of which are illustrated in FIGS. 5 and 6.

Caster wheels 60 are mounted at the lower ends of the legs of the end units in order to facilitate wheeling movement of the frame, and brake devices 61 are associated therewith so that the position of the entire assembly can be fixed relative to a support S which has been indicated in dotted lines in FIGS. 1 and 2, the top of which may serve as a demonstration area. The support S may be a surgical table, a stretcher or a morgue cart, of the type disclosed in U.S. Pat. No. 3,034,843, May 15, 1962.

The end units 10 and 20 are free of any bracing between the lower portions thereof so that the wheeled base may be transported easily to overlie the support S below the adjustable mirror. Also, longitudinal bracing bars 15 may extend between the end units at a level higher than the support S, so that these bars clear the support if the base is wheeled from a transverse direction.

As stated above, the wheeled base may be locked in position by applying the brakes 61 to the caster wheels, as is well known in the art and as is illustrated in U.S. Pat. No. 2,227,832, Jan. 7, 1971.

Figure 3:
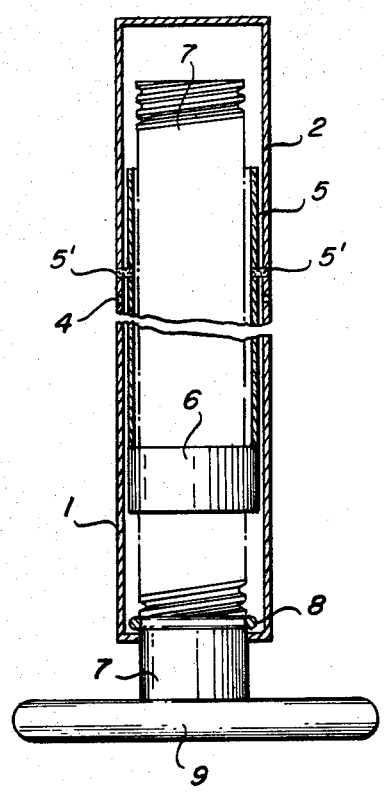
FIG. 3 is a sectional view, with certain parts in elevation, showing the adjusting means for varying the level of the horizontal pivotal axis of the mirror.

The vertical posts of the frame member at each end are of identical construction, only one of which is illustrated in FIG. 3. As stated above, these may be formed of stainless steel hollow tubing of the same dimensions as the members of the end units. The lower tube section 1, which is welded to the center of the end unit 20, is flanged internally to provide an opening at the bottom thereof for accommodating the free end of a cylindrical rod 7 of one and one-half inch diameter, with external threading of large pitch, such as one-fourth inch. The rod may be nineteen inches long and the same may engage an interanally threaded nut 6 at the lower end of an inner tube 5 which is welded by plug welds 5' to the interior of the upper tube section 2 adjacent to the lower end of the latter. Since both tube sections 1 and 2 are of the same dimensions and outline, they define a discontinuity or split 4 between their juxtaposed ends when the mirror is in its lowermost position.

A hand-wheel 9 is mounted at the bottom end of the screw rod 7 so that the rotation of this hand-wheel causes rotary movement only of the latter, by virtue of the stop-ring 8 in interengagement with the periphery of the rod above the flanged bottom of vertical post 1. This rotary movement effects translating movement of the nut 6 along the length of the screw rod, thereby moving the inner cylindrical tubing 5 and the upper section 2 to raise the latter quickly and easily from the position shown in FIG. 3 to a higher elevation which carries the hinged joint 50 therewith, the details of which are described hereinafter. The same manipulation of the companion hand-wheel 9' on the other end of the wheeled base serves to raise the pivotal axis of the mirror to any desired height afforded by the long screw rods 7.

Figure 4:
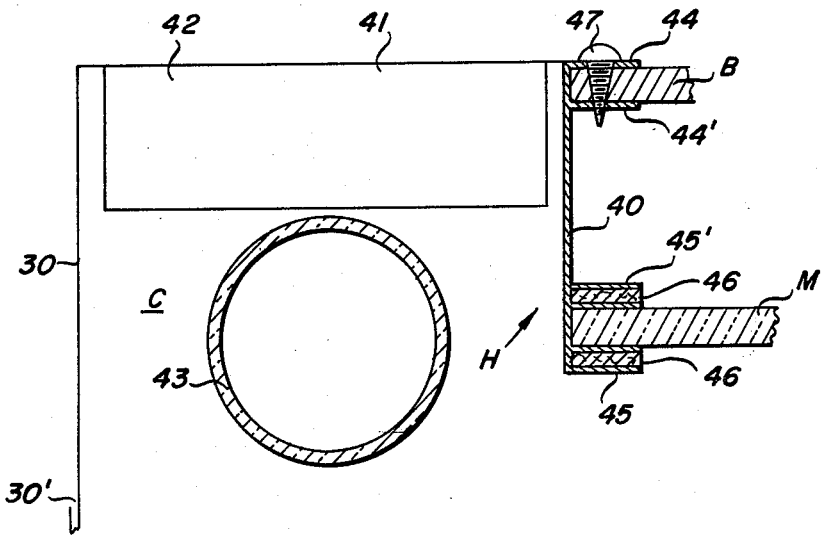
FIG. 4 is a horizontal sectional view along line 4—4 of FIG. 1.

The mirror housing H (FIG. 4), is preferably formed of heavy guage stainless steel with inwardly disposed channels along the opposite edges thereof. The channel at the front of the perimetric frame 40, formed between the flanges 45 and 45', accommodates a plane mirror M therebetween and if this mirror is formed of glass with a silvered surface, gaskets 46 on the opposite faces along the edges of the mirror serve to cushion the mirror therebetween.

The inwardly disposed channel between the flanges 44,44' adjacent the opposite edge of the frame 40, is adapted to receive a chalk-board B which may be retained within the channel by suitably disposed fastening screws 47. This chalk-board may serve as a useful adjunct to the demonstration if the latter is followed by an explanation requiring diagrams or other written explanatory material.

The rectangular frame 40 is surrounded by a channel C formed by a back plate 41 and a lateral plate 30, the free edge of which is turned at 30' for purposes of reenforcement and which, together with the outer edges of the mirror frame, serve as a repository for a plurality of fluorescent lamps 43 and ballast elements 42 therefor, for the purpose of illuminating the mirror and the surrounding area. A power outlet receptacle may be mounted on this channel so that any extension cord therefrom may supply energy for illuminating the mirror when this is desired. For example, the mirror shown in FIG. 1, having dimensions of ninety inches by twenty-four inches, may be surrounded by two four-foot, forty-watt fluorescent bulbs, both at the top and bottom, and one two-foot fluorescent bulb, of the same capacity, on each side. Thereby the demonstration area may be illuminated by lamps having a total wattage of two hundred forty watts. Some of these may be disconnected if desired.

Each lateral side of the mirror housing is provided with a trunnion 50 at its center, which is capable of rotary movement with respect to the upper portions of the vertical posts 2 and 2' around the longitudinal axis of the mirror housing.

As shown in FIG. 7, this trunnion may consist of a three-eighth inch bolt having its shank plug welded to a retaining plate 51 which may be affixed to the lateral wall 30 of the mirror housing by screws or bolts 52. A two inch square plate 55, which may have a thickness of one-fourth inch, is adapted to be countersunk at its center for the reception of the head 53 of the bolt 50, and is affixed to the inner end wall of the vertical post 2' by self-tapping screws 56. Thereby, the mirror housing H may swing within the frame by a countersunk bearing formed between the headed bolt 53 and the conical opening in the plate 55.

The degree of angular movement of the mirror housing H relative to the frame F may be controlled by an adjusting rod 35 extending between these units. In FIGS. 5 and 6 is shown a preferred embodiment for controlling the angularity of the mirror housing with respect to the frame, and a mode of fixing it in any adjusted position. One end of the adjusting bar 35 is pivotally connected to the upper end of the lateral wall of the mirror housing H, fittings for which are provided at 37 and 38. The portion of the arm 35 remote from the pivot 37 is slotted and the slot 36 is adapted to receive the shank of a threaded bolt 25 which is mounted on a bracket 15 affixed to the front face of the frame F. The bracket is of L-shaped cross-section and is provided with suitable means on its leg 17 for affization of the frame F. The leg 16, extending perpendicularly from the leg 17, has its outer face coincident with the inner wall of the vertical post. The bolt 25 passes through opening 18 in the leg 16 and the slot 36 with the head 26 thereof affixed to a lever 27 for the purpose of facilitating the rotation of this bolt. A cap-nut 28 is mounted on the free end of the bolt, so that the rotation of lever 27 effects a clamping action between the control arm 35 and the side of the frame, so that once a desirable angularity of the mirror is set, this setting can be fixed by a tightening between the bolt 25 and cap-nut 28 by the rotation of the control arm 27.

The disengagement of the bolt 25 from the slot 36 from the control arm 35 permits a complete rotation of the mirror housing to bring the chalk-board to the front of the steel housing as an alternative to the mirror in this position as illustrated in FIG. 1.

As described above, the wheeled frame in accordance with the invention permits the rapid transport thereof into cooperative position with an underlying support which thereafter may be locked in position by braking the caster wheels 60. The mirror frame can be raised to any desired elevated spacing from the top of the support by the rotation of the hand wheels 9 and 9'. Thereafter the angular position of the mirror may be adjusted by the manipulation of the control bar 35. One control bar at one side of the frame is sufficient for the adjustment of the angle of the mirror. If desired, this control means may be provided at either or both ends of the mirror assembly, or at an intermediate part thereof. In the latter case, the connection between the mirror housing and the frame would be made between the top edge of the mirror housing H and the horizontal frame member 3.

The illustrated embodiment of the invention is capable of modification in other respects without sacrificing its several advantageous features.

I claim:

1. In combination with a support adapted to have the top thereof viewed reflectively in a lateral direction, (a) a wheeled base of skeletal formation comprising a pair of end units, each with a pair of downwardly extending spaced legs free of any bracing therebetween at the lower portions thereof to form four downwardly extending spaced legs disposed at the four corners of a rectangular floor plan to permit free wheeling movement of said base relative to said support, (b) a frame member of rectangular outline extending upwardly from the top of said base comprised of a vertical post extending from the center of the top of each of said end units, with a horizontal beam extending between the upper ends of said vertical posts, (c) each of said vertical posts being of hollow tubular construction and constituted by a plurality of relatively telescopic parts, (d) a perimetric housing with a reflecting mirror carried thereby pivotally mounted between said vertical posts on a horizontal axis, comprising pivotal mounting means extending inwardly from the upper telescopic part of each post at the same distance below said horizontal beam, (e) means for varying the level of said pivotal horizontal axis with respect to the top of said support comprising threaded screw means having a large pitch on the interior of said telescopic parts, with rotary actuating means therefor beyond the lower end of each of said parts, and (f) connections between said frame member and housing for adjusting the angularity of said reflecting mirror with respect to the top of said support.

2. In combination with a support adapted to have the top thereof viewed reflectively in a lateral direction, (a) a wheeled base adapted to straddle said support, (b) a frame member extending upwardly from the top of said base comprising a vertical post at each end of said frame member, each vertical post being formed of an aligned upper and lower tube section, (c) a perimetric housing with a reflecting mirror carried thereby pivotally mounted between said vertical posts on a horizontal axis, said axis being adjacent to the bottom edge of said upper tube section, (d) means for varying the level of said pivotal horizontal axis with respect to the top of said support comprising an inner hollow tube fixedly mounted to the interior of said upper section and extending downwardly into the interior of said lower section, (e) an internally threaded nut with a large pitch at the bottom end of said hollow tube, (f) a rotary rod with threads of a pitch corresponding to those of said nut, extending upwardly from the bottom end of the lower tube section through said nut and the inner hollow tube and upper tube section, (g) means for rotating said rod at the lower end thereof, (h) means for limiting said rod to rotary motion only to impart rectilinear motion to said nut and the upper tube section connected thereto, and (i) connections between said frame member and housing for adjusting the angularity of said reflecting mirror with respect to the top of said support.

3. An apparatus as set forth in claim 2, wherein the upper and lower tube sections of each vertical post are of the same dimensions and of square cross-section.

4. In combination with a support adapted to have the top thereof viewed reflectively in a lateral direction, (a) a base of skeletal formation comprising a pair of end units, each with a pair of downwardly extending spaced legs free of any bracing therebetween at the lower portions thereof to form four downwardly extending spaced legs disposed at the four corners of a rectangular floor plan to permit free movement of said base relative to said support, (b) a frame member of rectangular outline extending upwardly from the top of said base comprised of a vertical post extending from the center of the top of each of said end units, with a horizontal beam extending between the upper ends of said vertical posts, (c) each of said vertical posts being of hollow tubular construction and constituted by a plurality of relatively telescopic parts, (d) a perimetric housing with a reflecting mirror carried thereby pivotally mounted between said vertical posts on a horizontal axis, comprising pivotal mounting means extending inwardly from the upper telescopic part of each post at the same distance below said horizontal beam, (e) means for varying the level of said pivotal horizontal axis with respect to the top of said support comprising threaded screw means having a large pitch on the interior of said telescopic parts, with rotary actuating means therefor beyond the lower end of each of said parts, and (f) connections between said frame member and housing for adjusting the angularity of said reflecting mirror with respect to the top of said support.

* * * * *